US009635715B1

(12) United States Patent
Miller et al.

(10) Patent No.: US 9,635,715 B1
(45) Date of Patent: Apr. 25, 2017

(54) SMART SUSCEPTOR RADIANT HEATER

(71) Applicant: The Boeing Company, Chicago, IL (US)

(72) Inventors: Robert James Miller, Fall City, WA (US); Marc R. Matsen, Seattle, WA (US); Diane C. Rawlings, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 751 days.

(21) Appl. No.: 13/889,657

(22) Filed: May 8, 2013

(51) Int. Cl.
*H05B 6/02* (2006.01)
*H05B 6/00* (2006.01)
*H05B 6/06* (2006.01)
*H05B 6/10* (2006.01)

(52) U.S. Cl.
CPC ..... *H05B 6/105* (2013.01)

(58) Field of Classification Search
CPC ... H05B 6/00; H05B 6/02; H05B 6/06; H05B 6/10; H05B 6/105
USPC ..... 219/603, 618–619, 634, 635, 638, 219/660–665, 671
See application file for complete search history.

(56) References Cited

U.S. PATENT DOCUMENTS 4,174,462 A * 11/1979 Pearce ..... C03B 5/021 219/634
4,959,516 A * 9/1990 Tighe ..... B65D 81/3446 219/730
5,062,386 A * 11/1991 Christensen ..... C23C 16/4411 118/715
6,528,771 B1 * 3/2003 Matsen ..... H05B 6/06 219/634
6,747,253 B1 * 6/2004 Firth ..... H05B 6/105 219/634
6,906,300 B2 6/2005 Brown et al.
7,109,451 B2 9/2006 Brown et al.
7,141,768 B2 * 11/2006 Malofsky ..... C09J 5/06 219/635
7,989,736 B2 * 8/2011 Park ..... H01L 21/67109
8,330,086 B2 12/2012 Miller et al.
9,165,704 B2 * 10/2015 Gore ..... H01F 6/04
2001/0035406 A1 * 11/2001 Ryan ..... C09D 167/00 219/634

(Continued)

*Primary Examiner* — Michael Laflame, Jr.
(74) *Attorney, Agent, or Firm* — Parsons Behle & Latimer

(57) ABSTRACT

A radiant heater having a ferromagnetic element includes a high emissivity surface and an induction coil operatively coupled with the ferromagnetic element. The induction coil may be energized to create eddy currents heating the ferromagnetic element until the element reaches its Curie temperature. At the Curie temperature the ferromagnetic element becomes substantially nonmagnetic and the temperature of the element remains relatively constant. The high emissivity surface of the heater provides a substantially uniform radiant heat to an object in close proximity to the high emissivity surface. The object may be thermally coupled with the high emissivity surface of the radiant heater. The radiant heater having a high emissivity surface may be used to heat temperature sensitive objects such as thin films. Multiple radiant heaters having different Curie temperatures may be used to ramp up a temperature, ramp down a temperature, or provide different temperatures required during a process.

19 Claims, 4 Drawing Sheets

(56) References Cited

U.S. PATENT DOCUMENTS

2002/0079121 A1* 6/2002 Ryan ..... C09D 167/00
174/68.1
2003/0226840 A1* 12/2003 Dalton ..... B01D 53/32
219/634
2005/0121437 A1* 6/2005 Spohn ..... B32B 27/20
219/635
2005/0185692 A1* 8/2005 Jeney ..... H05B 6/24
373/157
2005/0205568 A1* 9/2005 Brown ..... B29C 70/46
219/759
2006/0289420 A1* 12/2006 Hasegawa ..... H05B 6/145
219/216
2007/0102427 A1* 5/2007 Young ..... B65D 81/3446
219/759
2008/0283751 A1* 11/2008 Kymissis ..... G01J 5/34
250/338.3
2009/0127253 A1* 5/2009 Stark ..... B29C 35/0272
219/660
2009/0314770 A1* 12/2009 LaMarca ..... B29C 65/3612
219/633
2010/0092221 A1* 4/2010 Shinshi ..... G03G 15/2039
399/330
2010/0132921 A1* 6/2010 Moskal ..... B21D 53/02
165/104.19
2012/0118875 A1* 5/2012 Jussel ..... F27B 17/025
219/634
2012/0146426 A1* 6/2012 Sabo ..... H02J 7/025
307/104
2012/0193765 A1* 8/2012 Kelekar ..... H01L 21/02002
257/629
2013/0082047 A1* 4/2013 Matsen ..... H05B 6/06
219/634

* cited by examiner

SMART SUSCEPTOR RADIANT HEATER

BACKGROUND

Field of the Disclosure

The configurations described herein relate to a smart susceptor radiant heater. The smart susceptor radiant heater may include a high emissivity coating and induction coils. The smart susceptor radiant heater may be an air heater for drying or convection heating.

Description of the Related Art

Induction heating systems have been used to provide heat for processes such as fabricating parts or components. Induction heating systems typically include a susceptor (an electrically conducting material which can be ferromagnetic) that responds to electromagnetic flux generated by an energized induction coil by generating heat within the electrically conducting/ferromagnetic material. Heat is typically conducted from the electrically conducting/ferromagnetic element, hereinafter referred to as a ferromagnetic element, directly to the parts or components. Induction heating systems may also provide a heating element with a fairly stable temperature that may be preferred to heat certain objects, such as thin films, by radiation rather than by conduction which is the typical heat transfer mechanism utilized by typical induction heating systems.

Conventional heating equipment for the non-contact heating of objects such as films and coatings may not provide reliable uniform heat to heat the object. Conventional infrared or radiant heaters may not provide reliable uniform heating, which can result in overheating or under heating of the article being heated. Further, lack of spatial uniformity in conventional non-contact heating equipment may result in portions of an article being heated to different temperatures.

SUMMARY

It may be beneficial to provide a radiant heater having a ferromagnetic element including a high emissivity surface.

One configuration of a radiant heater includes a susceptor including a ferromagnetic element having a high-emissivity surface and an induction coil operatively coupled with the ferromagnetic element, wherein an application of electrical power to the induction coil generates eddy currents in the susceptor that heat the susceptor. The high-emissivity surface may comprise a coating on the surface of the susceptor. The coating may comprise black paint or a film that includes carbon black. The high-emissivity surface may comprise a micro-textured surface.

The ferromagnetic element of the radiant heater may be a sheet, a film, a wire, a composite, or combinations of these elements. The high-emissivity surface of the radiant heater may have an emissivity higher than 0.8. The high-emissivity surface of the radiant heater may have an emissivity higher than 0.9. The radiant heater may include at least one aperture through the susceptor. The radiant heater may include a feedback mechanism configured to reduce the application of power to the induction coiled when the entire susceptor is heated to a predetermined temperature. The predetermined temperature may be the Curie temperature of the ferromagnetic element of the radiant heater. The feedback mechanism of the radiant heater may monitor trends in electrical power applied to the induction coil. The ferromagnetic element of the radiant heater may be positioned within a matrix.

One configuration of a system for heating an object comprises a first susceptor including a ferromagnetic element having a high-emissivity surface, the first susceptor having a first Curie temperature, a first induction coil operatively coupled with the ferromagnetic element, and a first power source in electrical communication with the first induction coil, wherein application of power to the induction coil heats the first susceptor. The system may include an object positioned adjacent to the first susceptor, wherein a distance separates the object and the first susceptor. The system may include a roller. The object to be heated may be a thin film.

The system may include a second susceptor including a ferromagnetic element having a high-emissivity surface, the second susceptor having a second Curie temperature that differs from the first Curie temperature, a second induction coil operatively coupled with the ferromagnetic element, and a second power source in electrical communication with the second induction coil, wherein application of power in the second induction coil heats the second susceptor. The system may also include a third susceptor including a ferromagnetic element having a high-emissivity surface, the third susceptor having a third Curie temperature that differs from the first Curie temperature and the second Curie temperature, a third induction coil operatively coupled with the ferromagnetic element, and a third power source in electrical communication with the third induction coil, wherein application of power in the third induction coil heats the third susceptor.

A method of heating an object with a radiant heater comprises energizing an induction coil operatively coupled with a ferromagnetic element that includes an emissive surface, the ferromagnetic element having a Curie temperature and generating eddy currents within the ferromagnetic element until the ferromagnetic element is heated to the Curie temperature. The method further comprises positioning the object a selected distance from the emissive surface, such that the object and the emissive surface are thermally coupled but not in contact with each other and radiating heat that is substantially uniformly distributed from the emissive surface to the object. The emissive surface may be a high emissivity surface.

The method may include moving the object with respect to the ferromagnetic element. The method may include monitoring power provided to energize the induction coil to determine when the ferromagnetic element has been heated to the Curie temperature. The method may include energizing a second induction coil operatively coupled with a second ferromagnetic element that includes a second high emissivity surface, the second ferromagnetic element having a Curie temperature, wherein the Curie temperature of the second ferromagnetic element differs from the Curie Temperature of the ferromagnetic element, generating eddy currents within the second ferromagnetic element until the second ferromagnetic element is heated to the Curie temperature, and radiating uniformly distributed heat from the second high emissivity surface, wherein the second high emissivity surface and the object are thermally coupled.

Figure 1:
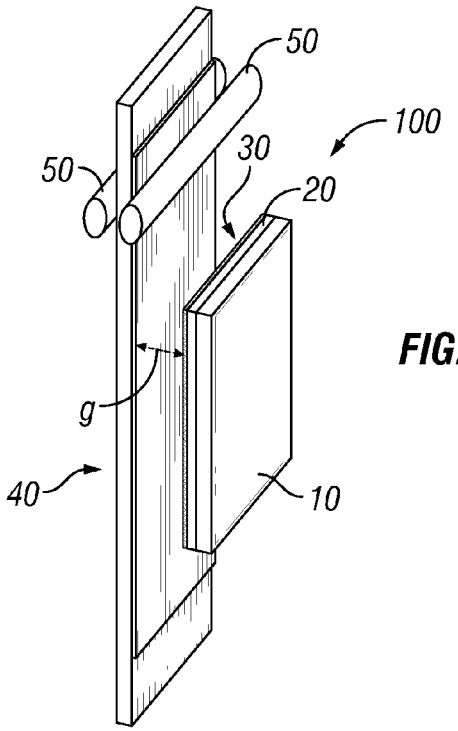
FIG. 1 shows a configuration of a radiant heater including a high emissivity surface positioned a minimum distance away from an object to be heated.

While the disclosure is susceptible to various modifications and alternative forms, specific configurations have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows one configuration of a smart susceptor radiant heater 100 being used to heat a thin or thick film 40. The film 40 may be comprised of multiple films to be laminated together at a very specific temperature. The thin film 40 may be run through rollers 50, which may be nip rollers, adapted to apply a desired force to the film 40 during the heating/lamination process. The smart susceptor radiant heater 100 may be used to heat various temperature sensitive objects. The object may be flat film as shown in FIG. 1 or may be an object with having a complex shape. The smart susceptor radiant heater 100 heats objects 40 by radiant heat rather than by conduction heating. The use of radiant heating having an emissive surface, or possibly a highly emissive surface, may be beneficial as some objects 40, such as films, coatings, electronics, and/or biological tissue may be damaged upon contact. The object may also be temperature sensitive. Thus a radiant heater 100 that has a stable and uniform heating temperature may be preferred. The object to be heated may be located a minimal distance g from the radiant surface of the radiant heater 100 so that the object 40 and the radiant heater 100 are thermally coupled together. For example, for roll-to-roll processes or for surface sensitive to touching, the minimal distance g may be approximately ¼ inch to prevent the inadvertent contacting of the radiant heater and the object 40 to be heated. The distance between the radiant heater 100 and the object 40 may be varied depending upon the overall geometrical dimensions of the system to ensure that the object 40 is thermally coupled with the radiant heater 100 as would be appreciated by one of ordinary skill in the art having the benefit of this disclosure. The effective width of the coupled area between the heater and the film decreases as the distance between them increases, e.g. a 30 inch wide radiant heater may uniformly heat a 30 inch wide film that is ¼ inches away from the radiant heater and may uniformly heat a 24 inch wide film that is 3 inches away from the heater and so on.

The smart susceptor radiant heater 100 includes an induction coil 10 connected to a power supply (shown in FIG. 4), a susceptor that includes a ferromagnetic element 20, and a high emissivity surface 30. The susceptor may comprise a ferromagnetic element 20 within a matrix. The matrix may be polymeric, ceramic, and/or non-ferromagnetic material. The smart susceptor radiant heater may be a rigid or flexible structure which may be used to conform to a complex shape or to provide application flexibility. As power is supplied to the induction coil 10 from the power supply, the induction coil 10 generates eddy currents within the ferromagnetic element 20 causing the heating up of the ferromagnetic element 20. The temperature of the ferromagnetic element 20 will rise until the ferromagnetic element 20 reaches its Curie temperature. The Curie temperature is the temperature where a ferromagnetic material experiences a fundamental change in its magnetic properties (permeability), i.e. from magnetic to non-magnetic. As portions of the ferromagnetic element 20 reach the Curie temperature, the magnetic permeability of those portions will drop rapidly. This drop in magnetic permeability eliminates the eddy currents within the ferromagnetic element 20, thus limiting the additional generation of heat for the portions that have reached the Curie temperature. The areas that are below the Curie temperature will continue to heat up until reaching the Curie temperature. Once the entire ferromagnetic element 20 has reached the Curie temperature, the entire ferromagnetic element 20 has become essentially non-magnetic and the induction coil 10 no longer generates significant eddy currents within the ferromagnetic element 20. The requisite power supplied to the induction coil 10 will be reduced as discussed below. The entire radiant heater 100 may not completely reach the Curie temperature as long as the radiant heater 100 is losing heat due to radiation or other means. Thus, the magnetic permeability may always be higher than 1. The magnetic permeability may stay just high enough to balance the loss of heat and maintain a uniform temperature very close to the Curie temperature.

The ferromagnetic element 20 of the smart susceptor radiant heater 100 may be adapted to have a desired Curie temperature as would be appreciated by one of ordinary skill in the art. Thus, the smart susceptor radiant heater 100 may be used to carefully control the heating of a temperature sensitive element, such as a thin film, coating, biological cell growth, electronic component, or to achieve controlled chemical reactions or crystal growth. The smart susceptor radiant heater 100 includes a high emissivity surface 30 adjacent to the object 40 that is to be heated via radiation from the smart susceptor radiant heater 100. Emissivity is the relative ability of the surface to emit energy by radiation. A high emissivity surface is defined herein as a surface that has an emissivity of 0.7 or greater. This emissivity is an integrated property over the blackbody spectrum for an object of the desired/specified heating temperature.

The high emissivity surface 30 of the smart susceptor radiant heater 100 permits the heater 100 to more efficiently radiate energy to heat the object 40. The high emissivity surface 30 may be a paint that is highly absorptive of thermal radiation at the desired heating temperature applied to the surface of the smart susceptor radiant heater 100 that is adjacent to the object 40 that is to be heated by the heater 100. The high emissivity surface 30 may be a matte or otherwise textured surface to mitigate interaction with the external environment. The high emissivity surface 30 may be a very thin coating on the surface of the heater 100 that is adjacent to the object being heated. For example, the high emissivity surface 30 may only be a few microns thick. The high emissivity surface 30 may be any surface and/or coating that has a 0.7 or greater emissivity. The high emissivity surface 30 may have an emissivity of approximately 0.8 or higher. The high emissivity surface 30 may have an emissivity of approximately 0.9 or higher. The high emissivity surface 30 may be a polymer film containing carbon black. The high emissivity surface 30 may be a metal with a highly textured surface. The high emissivity surface may be a microstructured surface created from a material that itself may or may not have high emissivity, e.g. m micro-textured metal surface. A surface with emissivity of less than 0.7 will require a substantially longer heating time (for a non-moving object) or a substantially longer heater (for a moving object).

The object 40 to be heated may be moved along a path adjacent to the high emissivity surface 30 of the radiant heater 100. For example, rollers 50 may move a plurality of films adjacent the radiant heater 100 to be heated. A plurality of rollers 50 of various configurations could be used in combination with a radiant heater 100 to heat and/or cure an object. The heating of the plurality of films may laminate the films together. The radiant heater 100 may also be moved along an object, such as a coating, to heat, dry, and/or cure the object. For example, the radiant heater 100 may be mounted on a device, such as a robot, that is configured to move the radiant heater 100 along a path adjacent to the object to be heated, dried, and/or cured.

Figure 2:
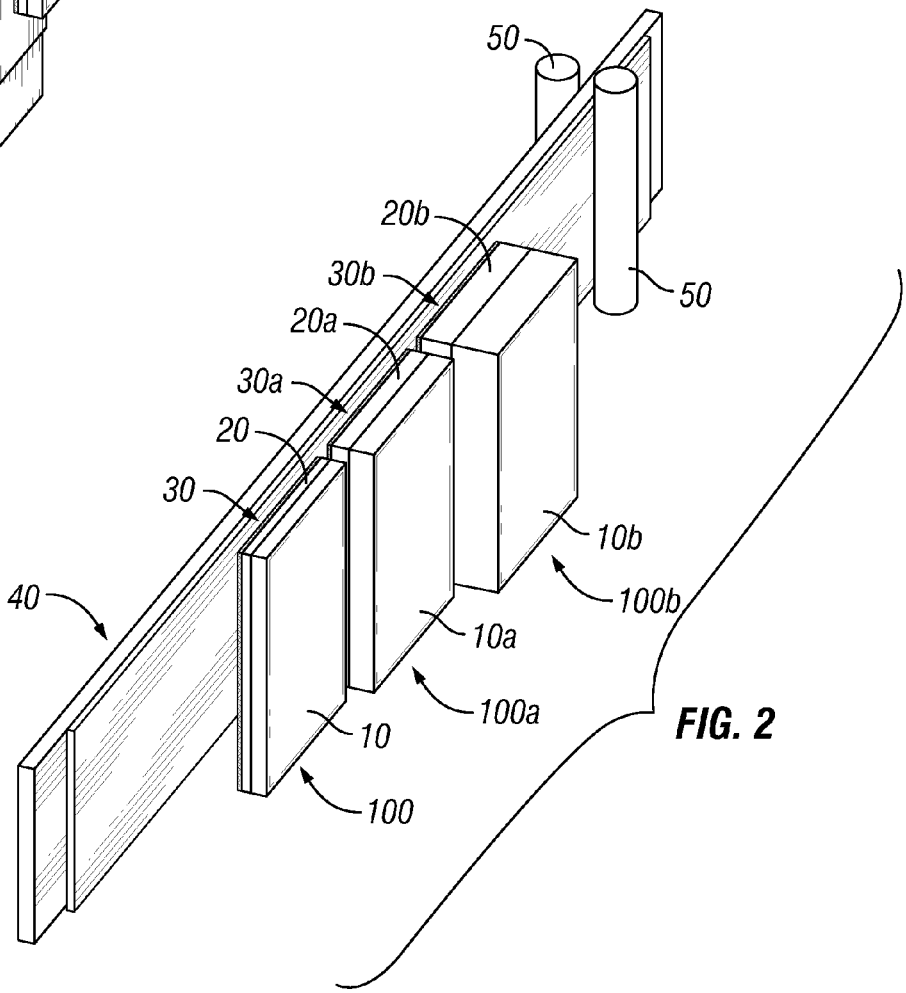
FIG. 2 shows multiple radiant heaters having high emissivity surfaces, the radiant heaters may each have a different Curie temperature.

FIG. 2 shows a system having an array of smart susceptor radiant heaters 100, 100A, 100B that may be used to heat an object 40. Each smart susceptor radiant heater 100, 100A, and 100B may be designed to have a Curie temperature different from the other smart susceptor radiant heaters 100, 100A, 100B. Each heater 100, 100A, and 100B includes an induction coil 10, 10A, and 10B, a ferromagnetic element 20, 20A, and 20B, and a high emissivity surface 30, 30A, and 30B. The use of multiple heaters 100, 100A, and 100B may be beneficial to gradually increase or decrease the temperature of an object 40 during a process. Additionally, different steps of a process may necessitate different temperatures during the different steps. For example, a first radiant heater 100 may be adapted to have a Curie temperature at 200° F., the second radiant heater 100A may be adapted to have a Curie temperature at 300° F., and the third radiant heater 100B may be adapted to have a Curie temperature at 400° F. Alternatively, different heaters could be used to compensate for edge effects such as radiative or conductive losses due to the part or heater edge configuration. The number, configuration, and Curie temperatures are provided for illustrative purposes only. The actual number, configuration, and Curie temperatures of the radiant heaters may be varied as needed as would be required by one of ordinary skill in the art having the benefit of this disclosure.

Figure 3:
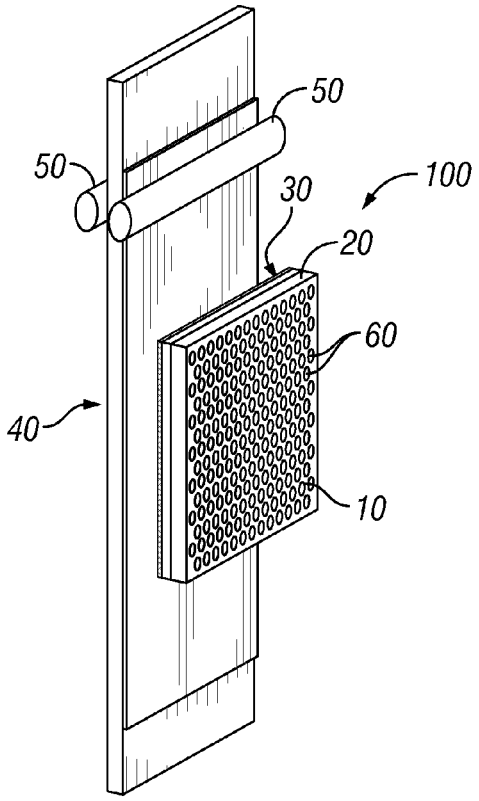
FIG. 3 shows a configuration of a radiant heater including a high emissivity surface with apertures through the radiant heater.

FIG. 3 shows a configuration of a radiant heater 100 that includes apertures 60 through the induction coil 10, the ferromagnetic element 20, and the high emissivity surface 30. The apertures 60 may permit the movement of air through the apertures 60 to aid in the removal of solvent vapors or in controlling humidity near the surface of object 40 adjacent to the high emissivity surface 30 or to aid in removal of solvents or reaction products. The heating system may include fans to promote the movement of air between the object 40 and the high emissivity surface 30 as well as through the apertures 60. The radiant heater could include channels or porosity for the air to flow through to be preheated before going through the apertures. The number, size, and configuration of the apertures 60 are for illustrative purposes only and may be varied depending on the desired application as would be appreciated by one of ordinary skill in the art having the benefit of this disclosure.

Figure 4:
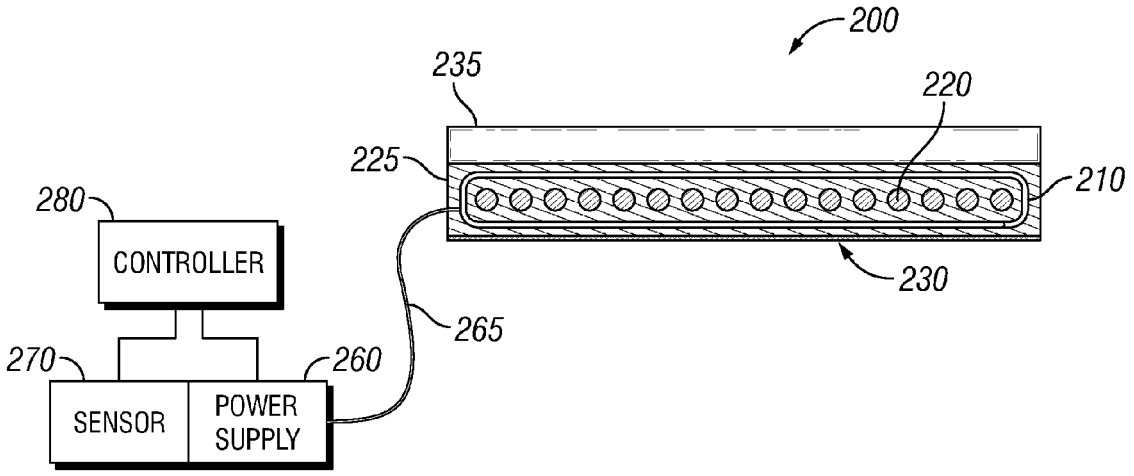
FIG. 4 shows a configuration of a radiant heater including a high emissivity surface connected to a power supply, a controller, and a sensor.

FIG. 4 shows a cross-section view of a configuration of a radiant heater 200 that includes ferromagnetic element in the form of wires 220 that are heated by applying power from a power supply 260 to an induction coil 210. As discussed above, the induction coil 210 generates eddy currents in the wires 220 that generate heat in the wires. The heat from the wires 220 heats up the matrix 225 that surrounds the wires 220. The heat from the matrix 225 is then radiated from the high emissivity surface 230 to heat up object(s) positioned adjacent to the high emissivity surface 230. The radiant heater 200 includes a thermally insulating structure 235 positioned above the induction coil 210. The thermally insulating structure 235 may permit the installation and/or attachment of a structure to the heater 200. The thermal insulator may also include a reflector to prevent radiation losses into the insulator. For example, the thermally insulating structure 235 may permit the attachment of the heater 200 to a fixture to position the high emissivity surface 230 a minimal distance, such as ¼ inch or less, away from an object to be heated. The thermally insulating structure 235 also may aid in the efficiency of the heat from the matrix 225 being radiated from the high emissivity surface 230 that would otherwise be conducted and/or emitted from the upper surface of the radiant heater 200.

A power supply 260 providing alternating current electric power may be connected to the induction coil 210 of the radiant heater 200 by wiring 265. The power supply 260 may be configured as a portable or fixed power supply which may be connected to a convention 60 Hz, 110 volt or 220 volt outlet. The frequency of the alternating current that is provided to the induction coil 210 may preferably range from approximately 1000 Hz to approximately 300,000 Hz. The voltage provided to the induction coil 210 may range from approximately 10 volts to approximately 300 volts. The alternating current provided to the induction coil 210 may range from approximately 10 amps to approximately 1000 amps. The power supply 260 may be provided in a constant-current configuration wherein the voltage across the induction coil 210 may decrease as the ferromagnetic material 220 approaches the Curie temperature.

The radiant heater 200 may include a feedback mechanism, such as thermal sensors, thermocouples, or other suitable temperature sensing devices, for monitoring heat along the high emissivity surface 230 of the radiant heater 200 in combination with a controller 280 to dynamically control the power supplied by a power supply 260. The radiant heater 200 may include a sensor 270 connected to the power supply 260. The sensor 270 may monitor the voltage or the current provided by the power supply 260. As discussed above, the power supply 260 may be provided as a constant current configuration to minimize unwanted resistive heating in the inductor coil 210. The sensor 270 may monitor changes in voltage, current, and/or power to determine when the ferromagnetic element 220 of the heater 200 has reached the Curie temperature.

The sensor 270 may be configured to indicate the voltage provided by the power supply 260. For a constant current configuration of the radiant heater 200, the voltage may decrease as the ferromagnetic element 220 approaches the Curie temperature. The power supply 260 may be configured to facilitate adjustment of the frequency of the alternating current in order to alter the heating rate of the magnetic material. The power supply 260 may be coupled with a controller 280 to facilitate adjustment of the alternating current over a predetermined range in order to facilitate the application of the radiant heater to a wide variety of objects having different heating requirements.

The power supply 260 may be configured to supply constant power permitting the current and voltage to change at a predetermined ratio while the wires 220 heat up to the Curie temperature. The sensor 270 can detect and indicate when the radiant heater 200 has reached the Curie temperature by detecting when the load from the induction coil 210 stops changing. When the radiant heater 200 reaches or approaches the Curie temperature, the power needed to drive the current through the wires 220 decreases substantially so that the only power costs is the power needed to heat the object coupled with the radiant heater 200. If the object being heated is already at the Curie temperature, then the object and the radiant heater 200 are emitting the same heat to each other (i.e. the two are thermally coupled in equilibrium) and the only power needed is the power required to offset any heat loss to the surrounding equipment. The thermally insulating structure 235 may help to minimize the heat lost from the radiant heater 200.

Figure 5:
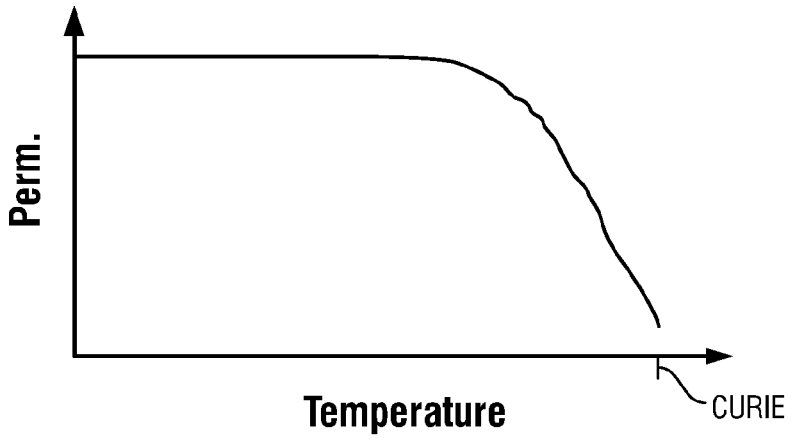
FIG. 5 is a graph showing a decrease in magnetic permeability of the ferromagnetic element of a radiant heater having a high emissivity surface as the temperature of the ferromagnetic element increases.

As discussed above, the ferromagnetic material 20, 220 becomes substantially non-magnetic when it reaches the Curie temperature. As the shown in FIG. 5, the magnetic permeability of the ferromagnetic material 20, 220 suddenly decreases when the ferromagnetic material 20, 220 reaches the Curie temperature. The sudden drop in magnetic permeability results in a reduction of the eddy currents generated by the induction coil and therefore a reduction of heating. The remaining portions of the ferromagnetic material 20, 220 continue to generate eddy currents.

Figure 6:
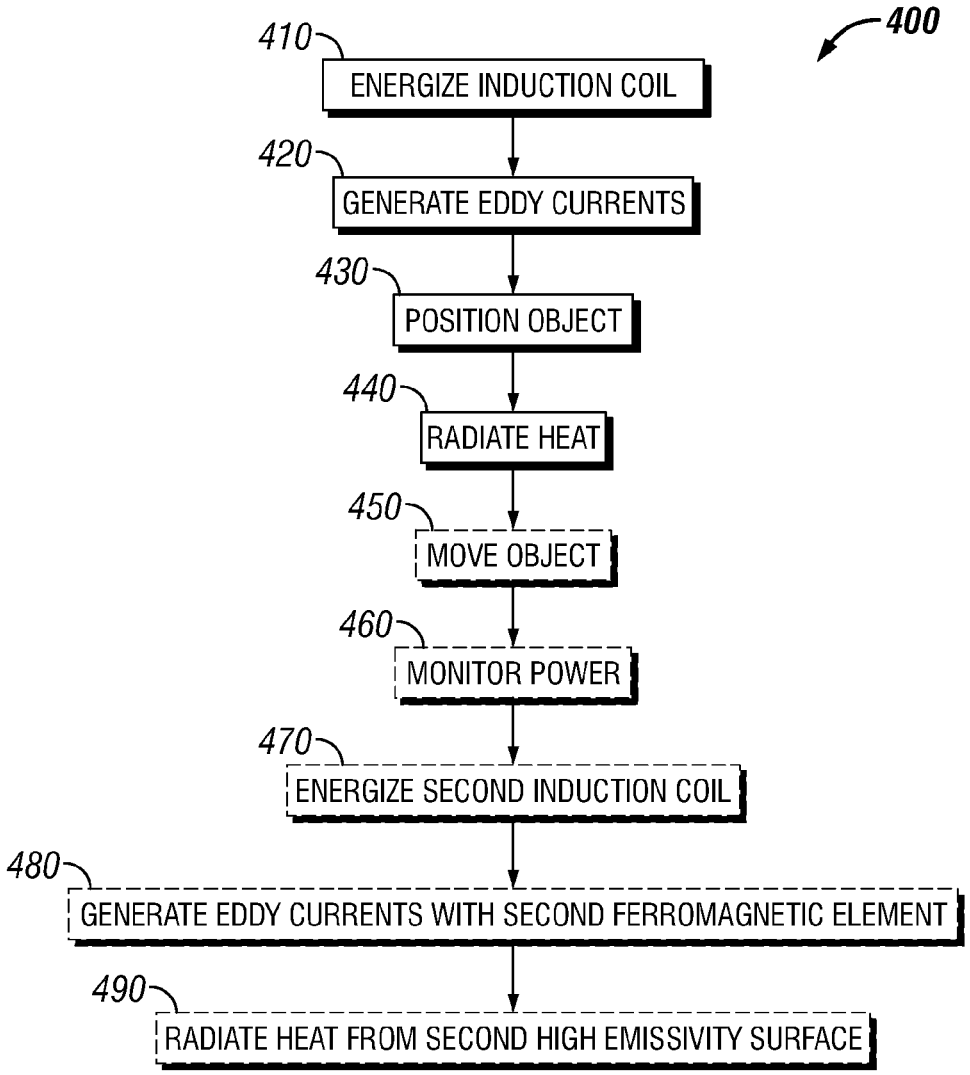
FIG. 6 is a flow diagram of a method of heating an object.

FIG. 6 shows a method of heating an object 400 that includes the step 410 of energizing an induction coil operatively coupled with a ferromagnetic element that includes a high emissivity surface. The ferromagnetic element has a Curie temperature at which the magnetic properties of the ferromagnetic element change. The method 400 includes the step 420 of generating eddy currents within the ferromagnetic element until the ferromagnetic element is heated to the Curie temperature and the step 430 of positioning the object a selected distance from the high emissivity surface of the ferromagnetic element, such that the object and the high emissivity surface are thermally coupled, but are not in contact with each other. The method 400 includes the step 440 of radiating heat that is substantially uniformly distributed from the high emissivity surface to the object.

The method 400 may include a step 450 of moving the object with respect to the ferromagnetic element and also may include a step 460 of monitoring power provided to energize the induction coil to determine when the ferromagnetic element has been heated to the Curie temperature. The method 400 may also include a step 470 of energizing a second induction coil operatively coupled with a second ferromagnetic element that includes a second high emissivity surface. The second ferromagnetic element may have a Curie temperature that differs from the Curie temperature of the first ferromagnetic element energized in step 410. The method 400 may also include a step 480 of generating eddy currents within the second ferromagnetic element until the second ferromagnetic element is heated to the Curie temperature and may also include a step 490 of radiating uniformly distributed heat from the second high emissivity surface, wherein the second high emissivity surface and the object are thermally coupled.

Figure 7:
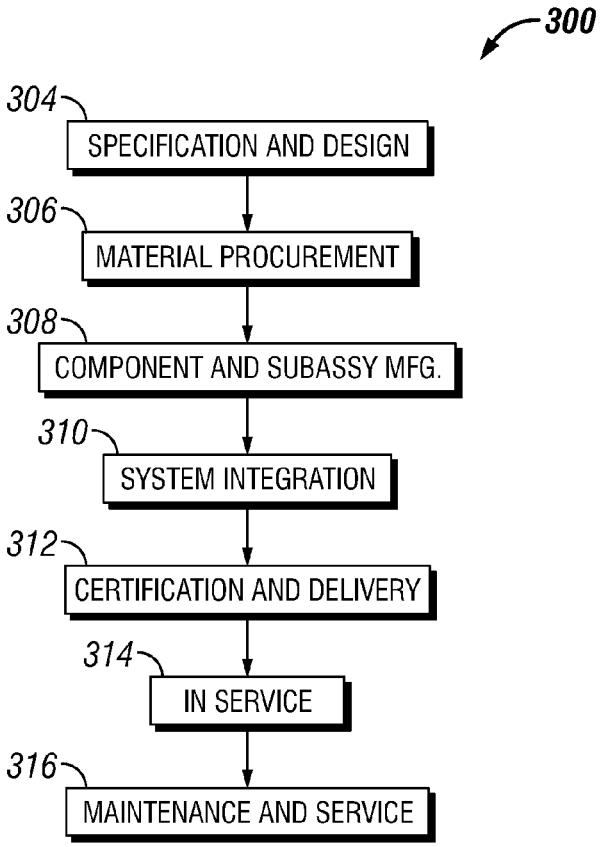
FIG. 7 is an illustration of a flow diagram of an aircraft production and service methodology.
Figure 8:
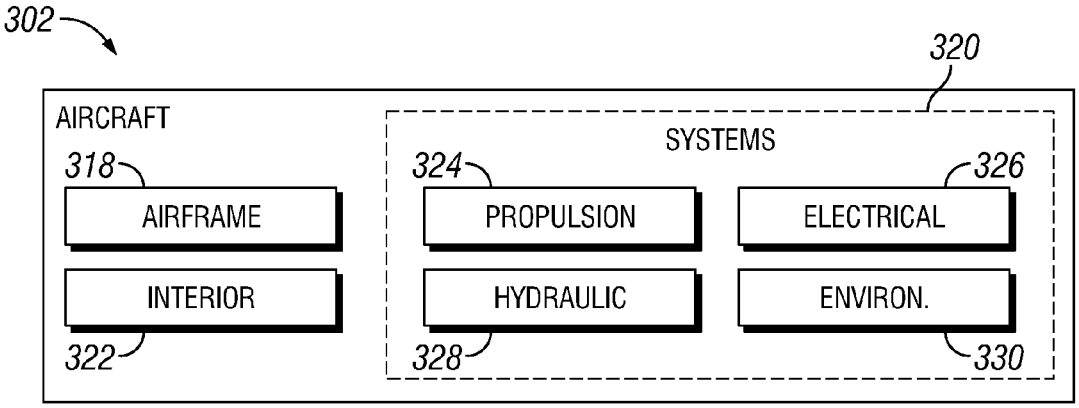
FIG. 8 is an illustration of a block diagram of an aircraft.

Referring to FIGS. 7-8, embodiments of the disclosure may be described in the context of an aircraft manufacturing and service method 300 as shown in FIG. 7 and an aircraft 302 as shown in FIG. 8. During pre-production, exemplary method 300 may include specification and design 304 of the aircraft 302 and material procurement 306. During production, component and subassembly manufacturing 308 and system integration 310 of the aircraft 302 takes place. Thereafter, the aircraft 302 may go through certification and delivery 312 in order to be placed in service 314. While in service 314 by a customer, the aircraft 302 is scheduled for routine maintenance and service 316 (which may also include modification, reconfiguration, refurbishment, and so on).

Each of the processes of method 300 may be performed or carried out by a system integrator, a third party, and/or an operator (e.g., a customer). For the purposes of this description, a system integrator may include without limitation any number of aircraft manufacturers and major-system subcontractors; a third party may include without limitation any number of vendors, subcontractors, and suppliers; and an operator may be an airline, leasing company, military entity, service organization, and so on.

As shown in FIG. 8, the aircraft 302 produced by exemplary method 300 may include an airframe 318 with a plurality of systems 320 and an interior 322. Examples of high-level systems 320 include one or more of a propulsion system 324, an electrical system 326, a hydraulic system 328, and an environmental system 330. Any number of other systems may be included. Although an aerospace example is shown, the principles of the disclosed embodiments may be applied to other industries, such as the automotive industry.

Apparatus and methods embodied herein may be employed during any one or more of the stages of the production and service method 300. For example, components or subassemblies corresponding to production process 308 may be fabricated or manufactured in a manner similar to components or subassemblies produced while the aircraft 302 is in service 314. Also, one or more apparatus embodiments, method embodiments, or a combination thereof may be utilized during the production stages 308 and 310, for example, by substantially expediting assembly of or reducing the cost of an aircraft 302. Similarly, one or more of apparatus embodiments, method embodiments, or a combination thereof may be utilized while the aircraft 302 is in service 314, for example and without limitation, to maintenance and service 316.

Although this disclosure has been described in terms of certain preferred configurations, other configurations that are apparent to those of ordinary skill in the art, including configurations that do not provide all of the features and advantages set forth herein, are also within the scope of this disclosure. Accordingly, the scope of the present disclosure is defined only by reference to the appended claims and equivalents thereof.

What is claimed is:

1. A system for heating an object, the system comprising:

a matrix, having a first surface and a second surface opposite the first surface, wherein the first surface is a high emissivity surface;

a ferromagnetic element positioned within the matrix, the ferromagnetic element having a Curie temperature;

an induction coil positioned within the matrix and operatively coupled with the ferromagnetic element;

a power source in electrical communication with the induction coil, wherein application of power to the induction coil heats the ferromagnetic element and wherein the heating of the ferromagnetic element heats the matrix; and a thermally insulating structure connected to the second surface of the matrix.

2. The system of claim 1, further comprising a sensor configured to monitor heat along the high emissivity surface and a controller connected to the sensor and the power source, wherein the controller is configured to decrease voltage from the power source as the ferromagnetic element approaches the Curie temperature.

3. The system of claim 1, further comprising a controller connected to the power source and connected a sensor configured to monitor a load of the induction coil, wherein when the load stop changing the controller reduces the application of power to the induction coil.

4. The system of claim 1, wherein the high-emissivity surface comprises a coating on the first surface.

5. The system of claim 4, wherein the coating comprises black paint or a film that includes carbon black.

6. The system of claim 1, wherein the high-emissivity surface comprises a micro-textured surface.

7. The system of claim 1, wherein the ferromagnetic element is selected from the group consisting of sheet, film, wire, composite, or combinations thereof.

8. The system of claim 1, wherein the high-emissivity surface has an emissivity higher than 0.8.

9. The system of claim 1, wherein the high-emissivity surface has an emissivity higher than 0.9.

10. The system of claim 1, further comprising at least one aperture through the matrix.

11. The system of claim 10, further comprising at least one fan configured for movement of air through the at least one aperture.

12. The system of claim 1, further comprising a feedback mechanism configured to reduce the application of power to the induction coiled when the ferromagnetic element is heated to a predetermined temperature.

13. The system of claim 12, wherein the predetermined temperature is the Curie temperature of the ferromagnetic element.

14. The system of claim 13, wherein the feedback mechanism monitors trends in electrical power applied to the induction coil.

15. The system of claim 1, wherein the high-emissivity surface is adjacent to an object to be heated.

16. The system of claim 15, wherein a distance separates the object and the high-emissivity surface.

17. The system of claim 16, further comprising a roller, wherein the object is a thin film.

18. The system of claim 1, wherein the matrix comprises a polymeric, ceramic, or non-ferromagnetic material.

19. The system of claim 1, wherein the thermally insulating structure further comprises a reflector.

* * * * *